US006086285A

United States Patent [19]

Christensen

[11] Patent Number: 6,086,285

[45] **Date of Patent: *Jul. 11, 2000**

[54] INTERLOCKING CONTROL BARRIER SYSTEMS

[75] Inventor: Marc E. Christensen, Salt Lake City, Utah

[73] Assignee: Off the Wall Products, LLC, Salt Lake City, Utah

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/974,001

[22] Filed: Nov. 19, 1997

Related U.S. Application Data

[63] Continuation-in-part of application No. 08/841,467, Apr. 22, 1997, Pat. No. 5,993,103, which is a continuation-in-part of application No. 08/661,445, Jun. 11, 1996, Pat. No. 5,836,714, which is a continuation-in-part of application No. 08/533,738, Sep. 26, 1995, Pat. No. 5,611,641, which is a continuation-in-part of application No. 08/278,495, Jul. 20, 1994, Pat. No. 5,452,963.

[51] Int. Cl.[7] ..... E01F 13/04

[52] U.S. Cl. ..... 404/6; 256/1; 256/19

[58] Field of Search ..... 404/6, 7, 9, 40, 404/41; 256/1, 13.1, 19

[56] References Cited

U.S. PATENT DOCUMENTS

| | | | |
|---|---|---|---|
| D. 349,738 | 8/1994 | Naegele, III et al. . | |
| 1,049,261 | 12/1912 | Pelissier . | |
| 2,161,193 | 6/1939 | Phillips . | |

(List continued on next page.)

FOREIGN PATENT DOCUMENTS

| | | | |
|---|---|---|---|
| B-50241/93 | 8/1994 | Australia . | |
| 407277 | 1/1991 | European Pat. Off. | 256/13.1 |
| 0 442 249 A1 | 2/1991 | European Pat. Off. . | |
| 0 442 249 A1 | 8/1991 | European Pat. Off. . | |
| 550362 | 7/1993 | European Pat. Off. | 256/13.1 |
| 2 619 400 | 2/1989 | France . | |
| 2660 945 A1 | 4/1990 | France . | |
| 2660945 | 10/1991 | France | 256/13.1 |
| 2 663 657 | 12/1991 | France . | |
| 2 743 825 | 7/1997 | France . | |
| 1658470 | 12/1970 | Germany . | |
| 942255 | 11/1963 | United Kingdom . | |
| 1 482 634 | 8/1977 | United Kingdom . | |
| 2 084 635 | 4/1982 | United Kingdom . | |
| 2 219 332 | 12/1989 | United Kingdom . | |
| 2 237 832 | 5/1991 | United Kingdom . | |
| 2240801 | 8/1991 | United Kingdom | 404/6 |
| 2 282 836 | 4/1996 | United Kingdom . | |

*Primary Examiner*—James A. Lisehora
*Attorney, Agent, or Firm*—Workman, Nydegger & Seeley

[57] ABSTRACT

A barrier system includes discrete movable barriers molded from a resiliently deformable plastic. Each of the barriers includes a housing having opposing front and back walls and opposing triangular shaped sidewalls. The front and back walls extend from a floor and intersect at a rounded top portion. Each barrier includes an interior surface that defines an internal chamber. The internal chamber can be selective filled with a ballast through an opening. Recessed within the front wall and back wall are a plurality of pockets. The pockets form reinforcing ribs which substantially prevent the deflection of front and back wall when the internal chamber is filled with ballast. In contrast, the sidewalls are substantially smooth to enhance bowing thereat when the internal chamber is filled with ballast. Recessed within the floor of each barrier adjacent to each of the sidewalls is a slot. Upstanding legs from an U-shaped connector are received within corresponding slots when sidewalls of adjacent barriers are biased together. The connector thus secures the barriers together. A tenon and mortise is formed on the front wall of each of the barriers and are configured such that front walls of opposing barriers can be mated together for stacking and storage. Each of the barriers can also include a rubberized pad mounted to the floor of the barrier to minimize sliding. A plate can also be mounted to each barrier to minimize the potential for tipping the barriers.

24 Claims, 10 Drawing Sheets

U.S. PATENT DOCUMENTS

| | | | |
|---|---|---|---|
| 2,794,375 | 6/1957 | DiFalco et al. . | |
| 2,893,148 | 7/1959 | Figman . | |
| 2,960,055 | 11/1960 | Tornek . | |
| 3,090,976 | 5/1963 | Liu . | |
| 3,141,655 | 7/1964 | Platt . | |
| 3,284,122 | 11/1966 | Rich . | |
| 3,503,600 | 3/1970 | Rich . | |
| 3,540,699 | 11/1970 | Guzzardella . | |
| 3,572,465 | 3/1971 | Olson . | |
| 3,661,359 | 5/1972 | Walker . | |
| 3,672,657 | 6/1972 | Young et al. . | |
| 3,822,954 | 7/1974 | Ansganiusson . | |
| 3,856,268 | 12/1974 | Fitch . | |
| 4,138,095 | 2/1979 | Humphrey . | |
| 4,169,688 | 10/1979 | Toshio | 404/40 |
| 4,279,105 | 7/1981 | Cameron | 52/71 |
| 4,298,186 | 11/1981 | Glass . | |
| 4,348,133 | 9/1982 | Trent et al. . | |
| 4,380,327 | 4/1983 | Fish . | |
| 4,423,854 | 1/1984 | Cobb et al. . | |
| 4,435,106 | 3/1984 | Förster et al. . | |
| 4,500,225 | 2/1985 | Quittner . | |
| 4,624,210 | 11/1986 | Glass . | |
| 4,665,673 | 5/1987 | Diana . | |
| 4,681,302 | 7/1987 | Thompson . | |
| 4,773,629 | 9/1988 | Yodock . | |
| 4,796,369 | 1/1989 | Hamann . | |
| 4,854,767 | 8/1989 | Sasaki . | |
| 4,869,617 | 9/1989 | Chiodo . | |
| 4,917,219 | 4/1990 | Henry | 188/32 |
| 4,925,333 | 5/1990 | Bishop . | |
| 4,943,035 | 7/1990 | Thomson et al. . | |
| 4,944,060 | 7/1990 | Perry et al. . | |
| 4,946,306 | 8/1990 | Yodock . | |
| 4,974,815 | 12/1990 | Glass | 256/64 |
| 4,978,245 | 12/1990 | White | 404/6 |
| 5,011,325 | 4/1991 | Antonioli | 404/6 |
| 5,106,554 | 4/1992 | Drews . | |
| 5,118,216 | 6/1992 | Smith | 404/6 |
| 5,122,008 | 6/1992 | Drews . | |
| 5,123,773 | 6/1992 | Yodock . | |
| 5,208,585 | 5/1993 | Sprague . | |
| 5,213,312 | 5/1993 | MacDonald . | |
| 5,226,439 | 7/1993 | O'Keeffe et al. | 135/66 |
| 5,269,623 | 12/1993 | Hanson . | |
| 5,387,049 | 2/1995 | Duckett . | |
| 5,412,381 | 5/1995 | Dicks . | |
| 5,452,963 | 9/1995 | Christensen | 404/6 |
| 5,460,353 | 10/1995 | Rittenhouse . | |
| 5,467,548 | 11/1995 | Ross . | |
| 5,498,101 | 3/1996 | Braverman | 404/6 |
| 5,605,413 | 2/1997 | Brown | 404/6 |
| 5,611,641 | 3/1997 | Christensen | 404/6 |
| 5,634,225 | 6/1997 | Miller, Sr. et al. . | |
| 5,639,179 | 6/1997 | Jensen . | |
| 5,772,357 | 6/1998 | Evans | 404/7 |
| 5,836,714 | 11/1998 | Christensen | 404/6 |
| 5,863,030 | 1/1999 | Kotler et al. | 256/24 |
| 5,882,140 | 3/1999 | Yodock, Jr. et al. | 404/6 |
| 5,993,103 | 11/1999 | Christensen | 404/6 |

INTERLOCKING CONTROL BARRIER SYSTEMS

This application is a continuation-in-part of application Ser. No. 08/841,467, now U.S. Pat. No. 5,993,103 filed Apr. 22, 1997, which is a continuation-in-part of application Ser. No. 08/661,445, now U.S. Pat. No. 5,836,714 filed Jun. 6, 1996, which is a continuation-in-part of application Ser. No. 08/533,738 filed Sep. 26, 1995, U.S. Pat. No. 5,611,641, which is a continuation-in-part of application Ser. No. 278,495, filed Jul. 20, 1994, U.S. Pat. No. 5,452,963. For the purpose of disclosure for the present application, the above identified references are incorporated herein by reference.

BACKGROUND OF THE INVENTION

1. The Field of the Invention

The present invention relates to barriers, and more particularly, portable, reusable, control barrier systems for use in controlling pedestrian and automobile traffic.

2. The Relevant Technology

Control barriers are used in a variety of situations. For example, control barriers can be selectively positioned at special events or construction sites to help direct pedestrian and automobile traffic in a desired direction. Alternatively, control barriers can be put up to help limit access to select areas. In yet other embodiments, control barriers can be put up to define an entertainment stage or the boundaries of a playing field. For example, control barriers can be used to define the boundaries of a soccer field or an ice skating rink.

Conventional control barriers have long comprised individual sawhorse type barriers or collapsible V-shape barricades. Such barriers, however, have limited use since they are generally lightweight and are thus easily tipped over or moved. This can be a problem when large crowds are encountered or when the barriers are being used on a playing field where they might get bumped. Furthermore, such barriers are typically not connected and often have spaces or gaps extending therethrough. As such, it is possible for individuals to either slip between or through the barriers.

Other barriers comprise various gates or walls which are constructed. Such barriers, however, require extensive time to assemble and disassemble. In yet other alternative embodiments, concrete barriers have been used. Although concrete barriers are not easily tipped over, such barriers are extremely heavy. As such, they are difficult to move and place in desired locations. Often, special equipment such as fork lifts or cranes are required. Furthermore, concrete barriers can be both difficult and expensive to move over large distances and require a large area to store. Concrete barriers can also be dangerous in that they are rigid and non-forgiving when impacted by a person.

In one attempt to overcome some of the above problems, plastic barriers have been made. The plastic barriers are hollow and can be filled with water for stabilizing. Although an improvement, plastic barriers also have several limitations. For example, plastic barriers are relatively slippery and thus can be pushed out of the way. Plastic barriers are also typically large and bulky. As a result, they are not easily stacked and require large areas to store. Finally, plastic barriers which are small enough to be practical to use at crowded events, are typically not sufficiently stable to be prevented from being tipped over.

OBJECTS AND BRIEF SUMMARY OF THE INVENTION

Accordingly, it is an object of the present invention to provide improved control barriers which are relatively light for ease in transport and positioning.

Another object of the present invention is to provide improved control barriers that once positioned are sufficiently stable to prevent being tipped over.

It is another object of the present invention to provided improved control barriers that have a sufficiently high coefficient of friction to prevent them from being easily pushed out of the way once positioned.

Yet another object of the present invention to provide control barriers which can be securely locked together.

Also, another object of the present invention is to provide control barriers which will yield slightly upon impact to lessen the damage to an object or individual colliding with the barrier.

Another object of the present invention is to provide improved control barriers that can be easily stacked for storage or transport in a relatively small area.

Finally, it is yet another object of the present invention to provide improved control barriers that are recyclable.

To achieve the forgoing objectives and in accordance with the invention as broadly described and claimed herein, a control barrier system is provided. The barrier system includes a plurality of discrete barriers. Each of the barriers includes a housing formed from a resiliently deformable semi-rigid material. The housing includes a back wall orthogonally extending from a floor to a top portion and a front wall sloping from the floor to the top portion of the back wall. The front and back walls also extend between opposing triangular shaped sidewalls. The housing further includes an interior surface that defines an internal chamber. The internal chamber is configured to receive a ballast, such as sand or water, and communicates with the exterior through an opening. In part, the ballast functions to stabilize the barrier.

Recessed within the floor of the barrier adjacent to each of the sidewalls is a slot. When desired, a connector is used to attach adjacent barriers together. The connector has a substantially U-shaped configuration and includes a cross-member having a leg upstanding from each of the opposing ends thereof. When the sidewalls of adjacent barriers are biased together, the legs of the connector can be received within corresponding slots in the floor of each of the barriers. If desired, bolts can then be used to mechanically secure the connector to the corresponding barrier.

As ballast is inserted into the barriers, the sidewalls bow outwardly under the weight of the ballast. Where the sidewalls are held together by the connector, the biasing force produced between the sidewalls increases the frictional engagement between the barriers and produces a tension on the connector. As a result, the strength of the connection between the barriers is significantly increased.

In one embodiment of the present invention, a display recess is formed in the front wall and back wall of the barrier. Each display recess is configured to receive a display, such as an advertising display. To prevent deflection of the front and back wall and thus distortion of the displays therein, a plurality of pockets are recessed within each of the walls. The pockets create reinforcing ribs which increase the rigidity of the walls. Increasing the rigidity of the front and back walls also facilitates maximum deflection or bowing in the sidewalls. Such deflection is desirable for enhancing the function of the connector.

In another embodiment of the present invention, a tenon projects from the front wall of the barrier adjacent to the floor. A complementary mortise is formed in the front wall of the barrier adjacent to the top portion thereof. The tenon and mortise are selectively positioned such that by biasing the front wall of an inverted barrier against the front wall of an upstanding barrier, the tenon of each barrier is received within the mortise of the other barrier. As a result, the barrier are mated together to facilitate easy stacking and storage.

When desired, a rubberized pad can be mounted to the bottom surface of the barrier. The rubberized pad increases the coefficient of friction between the barrier and the ground surface, thereby minimizing unwanted sliding of the barrier. To help prevent tipping of the barrier at crowded events, a plate can also be removably mounted to the floor of the barrier The plate comprises a first end that attaches to the barrier and a second end that preferably projects several feet away from the barrier. The plate would be directed towards the crowed such that the crowed would be standing on the plate when the crowed is biased against the barrier.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
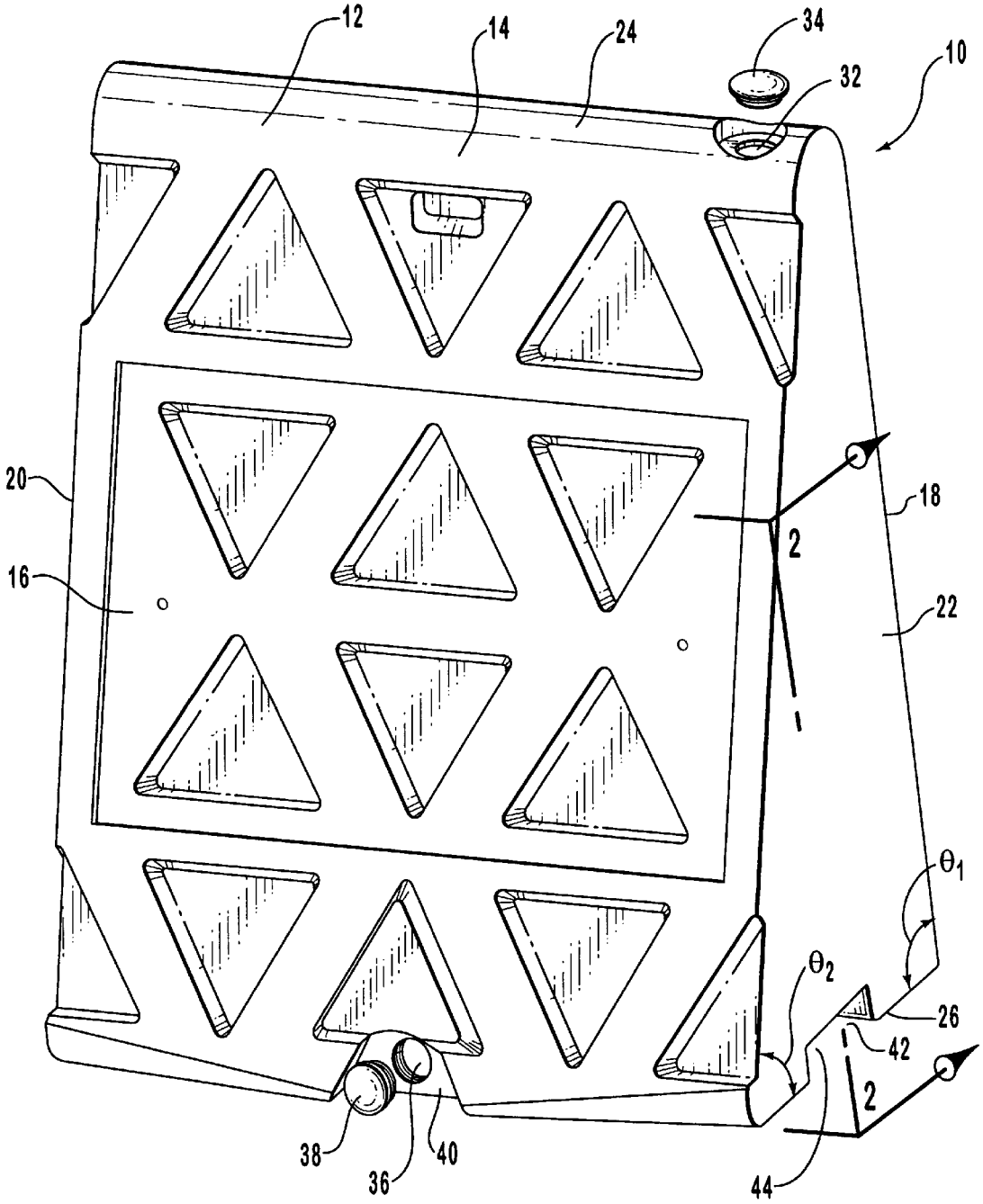
FIG. 1 is perspective view of an inventive barrier.

Depicted in FIG. 1 is one embodiment of an inventive barrier 10 incorporating features of the present invention. Barrier 10 comprises a housing 12 having an exterior surface 14. Housing 12 structurally includes a front wall 16 and an opposing back wall 18 each extending between opposing sidewalls 20 and 22. Each of sidewalls 20 and 22 likewise extend between a rounded top end 24, where front wall 16 and back wall 18 intersect, and an opposing floor 26.

Front wall 16 and back wall 18 are depicted as being substantially square. In alternative embodiments they can have alternative geometrical shapes such as rectangular or curved to form a corner. Sidewalls 20 and 22 are depicted as being substantially triangular. Specifically, back wall 18 intersect with floor 26 at an inside angle $\theta_1$ at about 90°. In alternative embodiments, angle $\theta_1$ can be in a range between about 70° to about 90° with about 80° to about 90° being more preferred. Front wall 16 intersects with floor 26 at an angle $\theta_2$ in a range between about 30° to about 60° with about 40° to about 50° degrees being more preferred and about 45° being most preferred.

Figure 2:
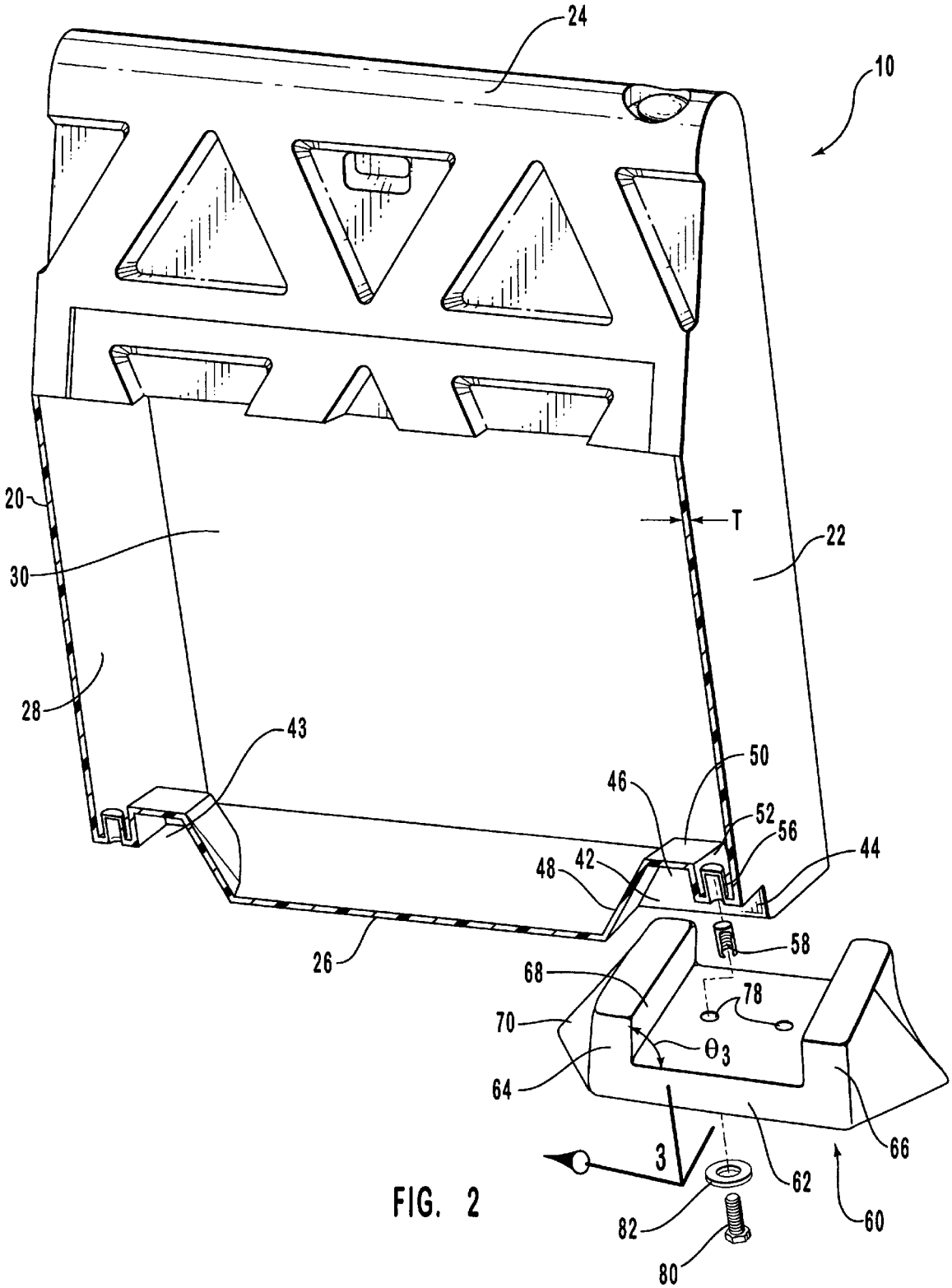
FIG. 2 is a partially cut away perspective view of the barrier shown in FIG. 1 taken along section line 2—2 and including a connector.

As depicted in FIG. 2, barrier 10 also has an interior surface 28 that bounds an internal chamber 30. Internal chamber 30 is configured to receive a ballast. As used in the specification and appended claims, the term "ballast" is broadly intended to include any materials which can be poured into internal chamber 30. By way of example and not by limitation, the ballast can include water, salt water, non-freezing fluids, sand, rock, cement, and concrete.

In one embodiment of the present invention, means are provided for filling internal chamber 30 with ballast. By way of example and not by limitation, depicted in FIG. 1, internal chamber 30 communicates with the exterior through an opening 32 located at top end 24. Opening 32 can be selectively sealed closed by a cap 34. In alternative embodiments, opening 32 can be positioned at other locations on barrier 10. Means are also provided for selectively draining ballast from barrier 10. By way of example and not by limitation, a threaded drain hole 36 extends through front wall 16 adjacent floor 26. Plug 38 can be screwed into drain hole 36 for sealing drain hole 36 closed. In alternative embodiments, drain hole 36 can also be positioned at other locations on barrier 10. To help prevent plug 38 from accidentally being knocked out of drain hole 36, drain hole 36 is preferably positioned within a recess 40.

Barrier 10 is preferably made of a resiliently deformable plastic material having strong, semi-rigid, and energy absorbing properties. Such materials include linear or cross-linked plastics which will deform under pressure but will not fail in a brittle manner. Examples of conventional plastics include polyethylene, polyvinylchloride, nylon, polycarbonate, and polypropylene. Additives such as dyes, pigments, and reinforcements, such as fibers, can also be added to the material. Florescent dies can also be added to help barriers 10 glow at night for better direction of traffic. In one embodiment, it is preferred that barrier 10 be made from a recyclable plastic such as polyethylene. This enables old or broken barriers to be ground down and recycled into new barriers.

Barrier 10 is preferably made by rotational molding. Of course, other molding processes, such as injection molding or die molding, can also be used. Independent of the method used, it is generally desirable that barrier 10 have a substantially uniform thickness T so as to minimize shrink deformation. In one embodiment, barrier 10 has a thickness T in a range between about 0.08 inches to about 0.5 inches with about 0.1 inches to about 0.3 inches being more preferred. The thickness is chosen to optimize desired deflection and required strength properties.

In one embodiment of the present invention, means are provided for connecting together a pair of discrete barriers 10 such that the strength of the connection therebetween increases as the pair of barriers 10 are filled with ballast. By way of example and not by limitation, depicted in FIGS. 1 and 2, a slot 42 is recessed within floor 26 adjacent to sidewall 22. Slot 22 comprises a horizontal portion 44 that extends through sidewall 22 and intersects with a vertical portion 46. Vertical portion 46 projects into floor 26 towards top end 24. Vertical portion 46 is in part bounded by a curved and outwardly sloping inside wall 48, a roof 50, and an outside wall 52. Extending between outside wall 52 and sidewall 22 is a platform 54. A hollow plug 56 upwardly extends from platform 54. Securely received within hollow plug 56 is a threaded insert 58.

Recessed within floor 26 adjacent to sidewall 20 is a slot 43. Slot 43 is substantially 8 identical to slot 42. Identical structural elements between slot 42 and slot 43 are thus identified by like reference characters.

Slots 42 and 43 are configured to receive a corresponding connector 60. Connector 60 is substantially U-shaped and includes a cross-member 62 having legs 64 and 66 upstanding from opposing ends thereof. Connector 60 is preferably made from the same materials and in the same process as barrier 10. Each of legs 64 and 66 has an inside face 68 and an opposing outside face 70. Inside face 68 preferably forms an angle $\theta_3$ relative to a top surface 75 of cross-member 62 less than 90°. More preferably, angle $\theta_3$ is in a range between about 75° to about 85°. Outside face 70 has a substantially conical configuration complementary to inside wall 48 of slot 42.

Figure 3:
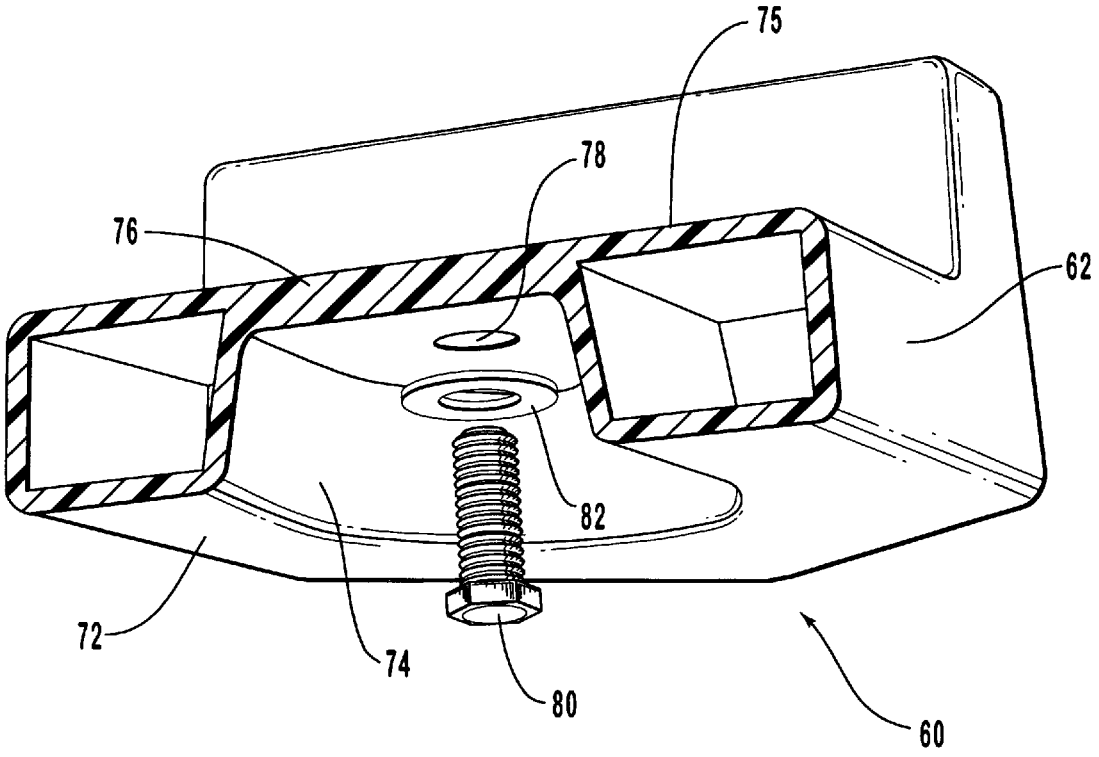
FIG. 3 is a cross-sectional perspective view of the connector shown in FIG. 2.

Depicted in FIG. 3, cross member 62 has a bottom surface 72 with a recess 74 formed therein. Extending between recess 74 and the top surface 75 of cross member 62 is a solid plate portion 76. As depicted in FIGS. 2 and 3, a pair of spaced apart apertures 78 extend through plate portion 76. Each aperture 78 is configured to align with a corresponding threaded insert 58 when each leg 64 or 66 is received within a corresponding slot 42 or 43. As a result, a threaded bolt 80 having a washer 82 mounted thereon can be passed through aperture 78 and screwed into threaded insert 58 for securing connector 60 to barrier 10.

Figure 4:
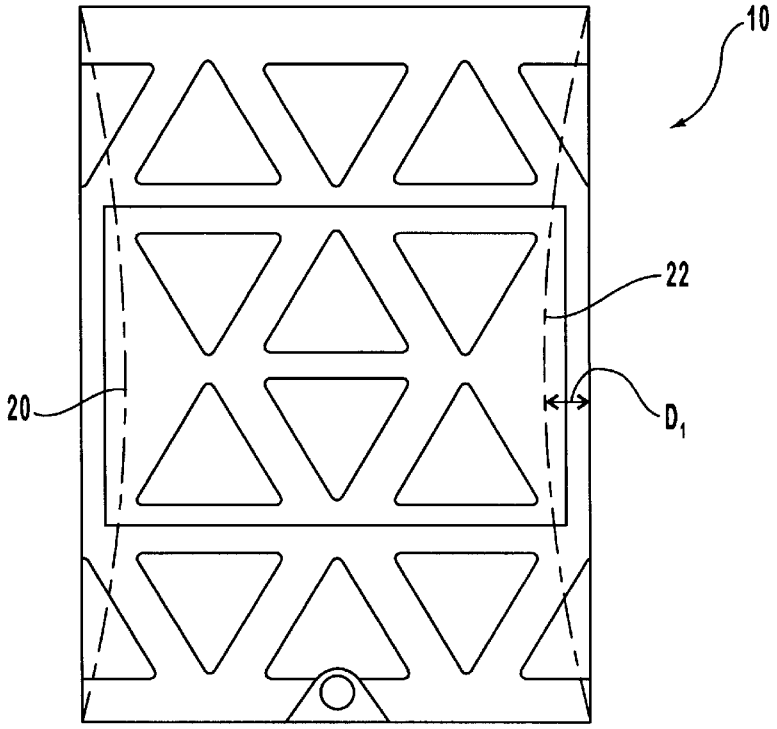
FIG. 4 is a schematic representation of the barrier shown in FIG. 1 absent ballast.
Figure 5:
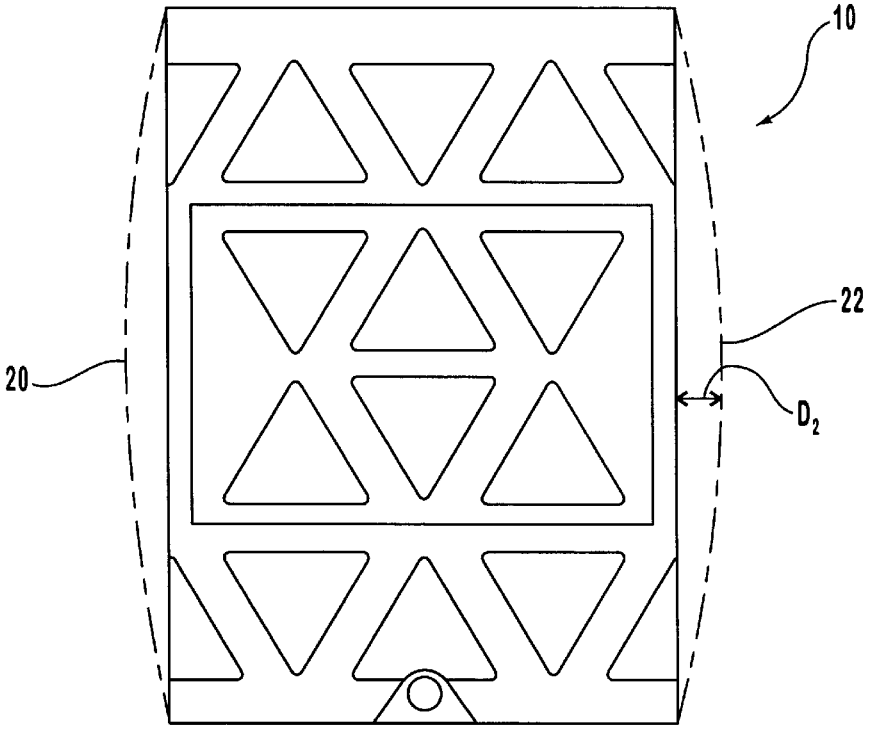
FIG. 5 is a schematic representation of the barrier shown in FIG. 1 having ballast received therein.

As depicted in FIG. 4, barrier 10 is configured such that when internal chamber 30 is absent a ballast, sidewalls 20 and 22, as depicted by the dashed lines, bow inward. In one embodiment, sidewalls 20 and 22 can inwardly bow a maximum distance $D_1$ in a range between about 0.1 inches to about 1 inch with about 0.3 to about 0.7 inches being more preferred. In contrast, as depicted in FIG. 5, as internal chamber 30 is filled with a ballast, such as water, sidewalls 20 and 22 bow outward. In one embodiment, sidewalls 20 and 22 can outwardly bow a maximum distance $D_2$ in a range between about 0.1 inches to about 2.5 inches with about 1 inch to about 2 inches being preferred. Of course, the extent which sidewalls 20 and 22 can bow outwardly depends on the weight and amount of ballast that is positioned within barrier 10.

Figure 6:
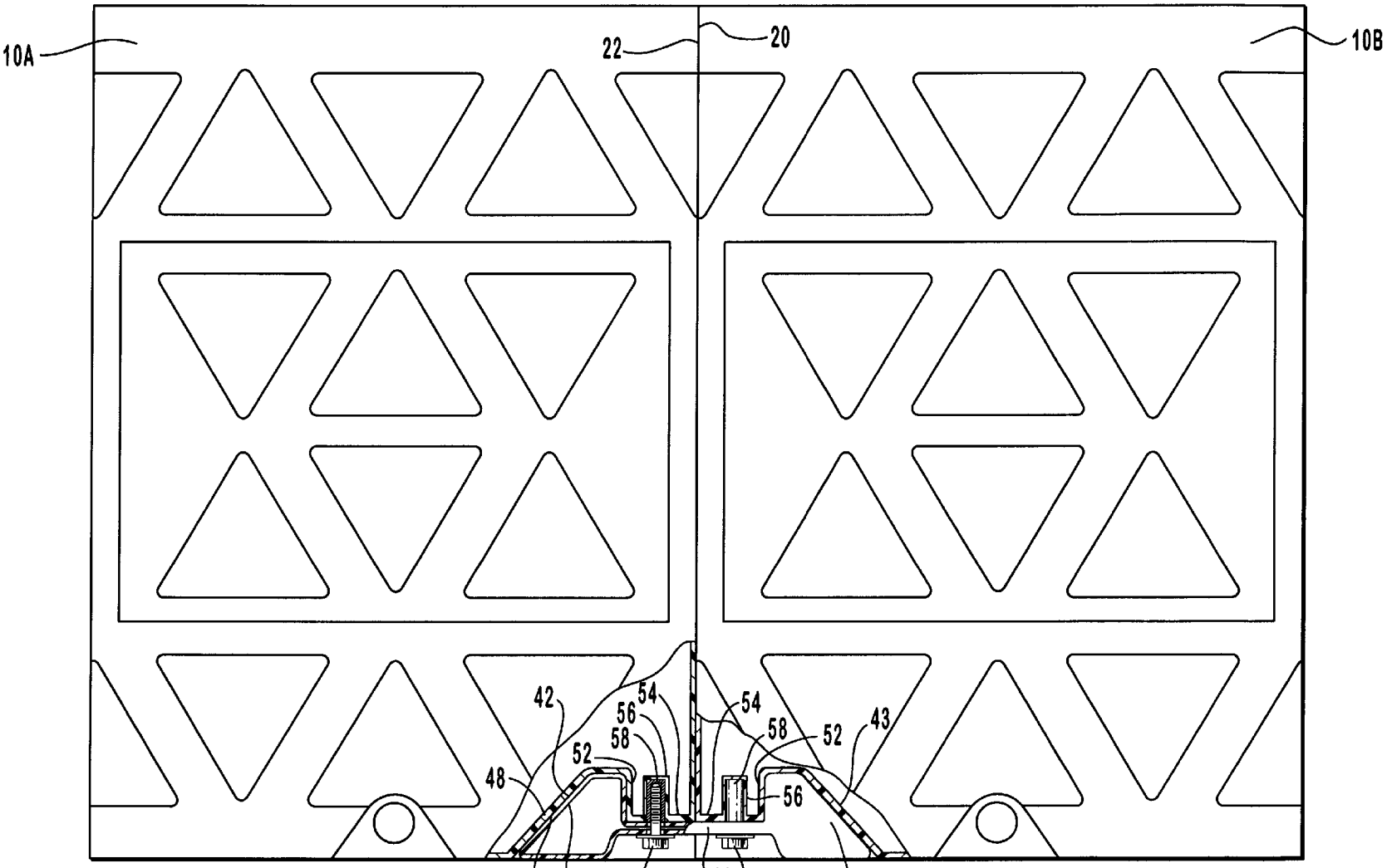
FIG. 6 is a partially cut away front view of a pair of barriers shown in FIG. 1 attached by the connector.

As depicted in FIG. 6, when it is desirable to attach a pair of barriers 10 together, leg 64 of connector 60 is received within slot 42 of a first barrier 10A. Inside wall 48 of barrier 10A and outside face 70 of connector 60 are complementary configured as previously discussed so that leg 64 is self seating within slot 42. A bolt 80 can then be used to mechanically secure connector 60 to barrier 10A. It is noted that bolts 80 are often not required since the weight of barrier 10 having a ballast is usually sufficient to keep barrier 10 attached to connector 60.

Sidewall 20 of a second barrier 10B is then biased against sidewall 22 of first barrier 10A so that leg 66 of connector 60 is received within slot 43 of second barrier 10B. If desired, bolt 80 can then be used to mechanically secure connector 60 to second barrier 10. In this configuration, each of barriers 10A and 10B are connected together. As barriers 10A and 10B are filled with ballast, sidewalls 20 and 22 outwardly bow against each other. Separation of barriers 10A and 10B, however, is prevented as a result of connector 60. Specifically, legs 64 and 66 of connector 60 bias against corresponding outside walls 52 to prevent separation of barriers 10A and 10B. The use of bolts 80 can also help to prevent separation. As a result of the outward bowing of sidewalls 20 and 22, a tension is placed on connector 60 and the frictional engagement between barrier 10A and 10B is increased. These forces increase the strength of the connection between barriers 10A and 10B. In alternative embodiments, substantially the same effect can be achieved by filling one of the barriers with ballast.

Figure 7:
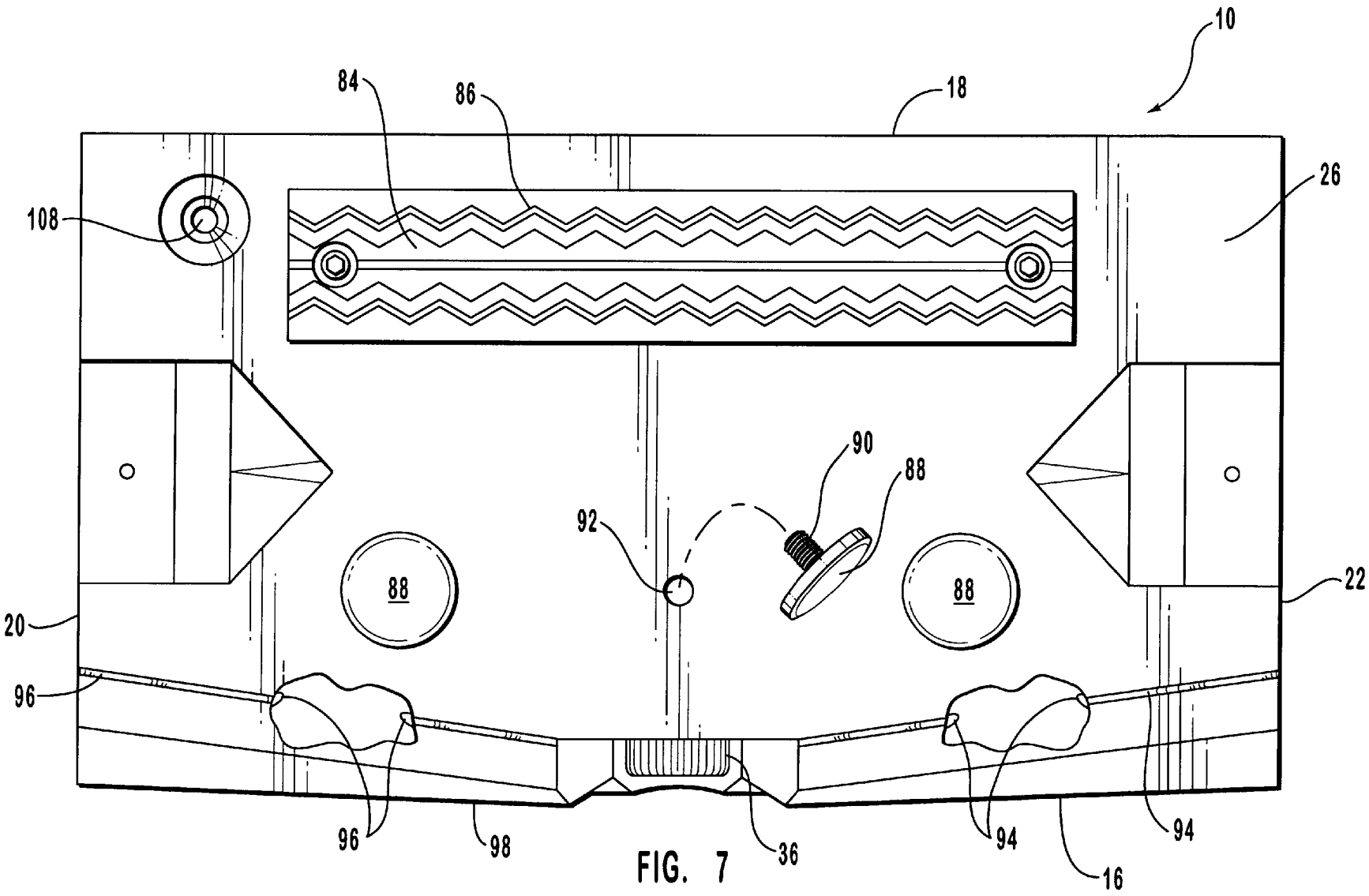
FIG. 7 is a partially cut away plan bottom view of the barrier shown in FIG. 1.

Depicted in FIG. 7 is the exterior surface of floor 26. In one embodiment of the present invention, means are provided for increasing the coefficient of friction of barrier 10. This helps to decrease unwanted sliding of barrier 10. By way of example and not by limitation, removably mounted to floor 26 are pads 84. Pads 84 preferrably produce a coefficient of friction between barrier 10 and pavement greater than about 0.3, preferably greater than about 0.5 and more preferraly greater than about 0.7. Pads 84 can comprise virtually any material that produces the desired coefficient of friction. Common materials are rubbers and elastomerss. In one embodiment, pads 84 comprise an elongated section of a rubberized tire 86. Attachment of tire section 86 not only increases the frictional engagement between barrier 10 and a corresponding ground surface but also functions as a useful means for recycling used tires. Tire section 86 can be attached by using bolts in the same way that connector 60 is attached to barrier 10. In alternative embodiments, adhesive or other fastening structures can be used. In an alternative embodiment, smaller pads 88 can be used that are integrally molded with a threaded post 90. Post 90 can be directly screwed into a threaded recess 92 formed in floor 26. In yet other embodiments, high friction materials, such as rubber, can be molded, sprayed, or otherwise secured to floor 26.

Projecting from the interior surface of floor 26 towards top portion 24 are a pair of drain ridges 94 and 96. Drain ridge 94 extends from drain hole 36 to sidewall 22. Drain ridge 96 extends from drain hole 36 to sidewall 20. Each drain ridge 94 and 96 is sloped 24 slightly back towards back wall 18 and facilitates in drainage of ballast from internal chamber of barrier 10. That is, once the ballast has self-drained through drain hole 36, barrier 10 can be tilted forward so that water settled on floor 26 of barrier 10 flows towards edge 98 along which drain hole 36 is positioned. Drain ridges 94 and 96 in turn channel the ballast towards drain hole 36. Although some ballast may flow over drain ridges 94 and 96, barrier 10 can be tilted back towards back wall 18 and then tilted forward again to ensure all of the water is removed from barrier 10 To assist in rolling or tilting barrier 10 forward, edge 98 is rounded.

Figure 8:
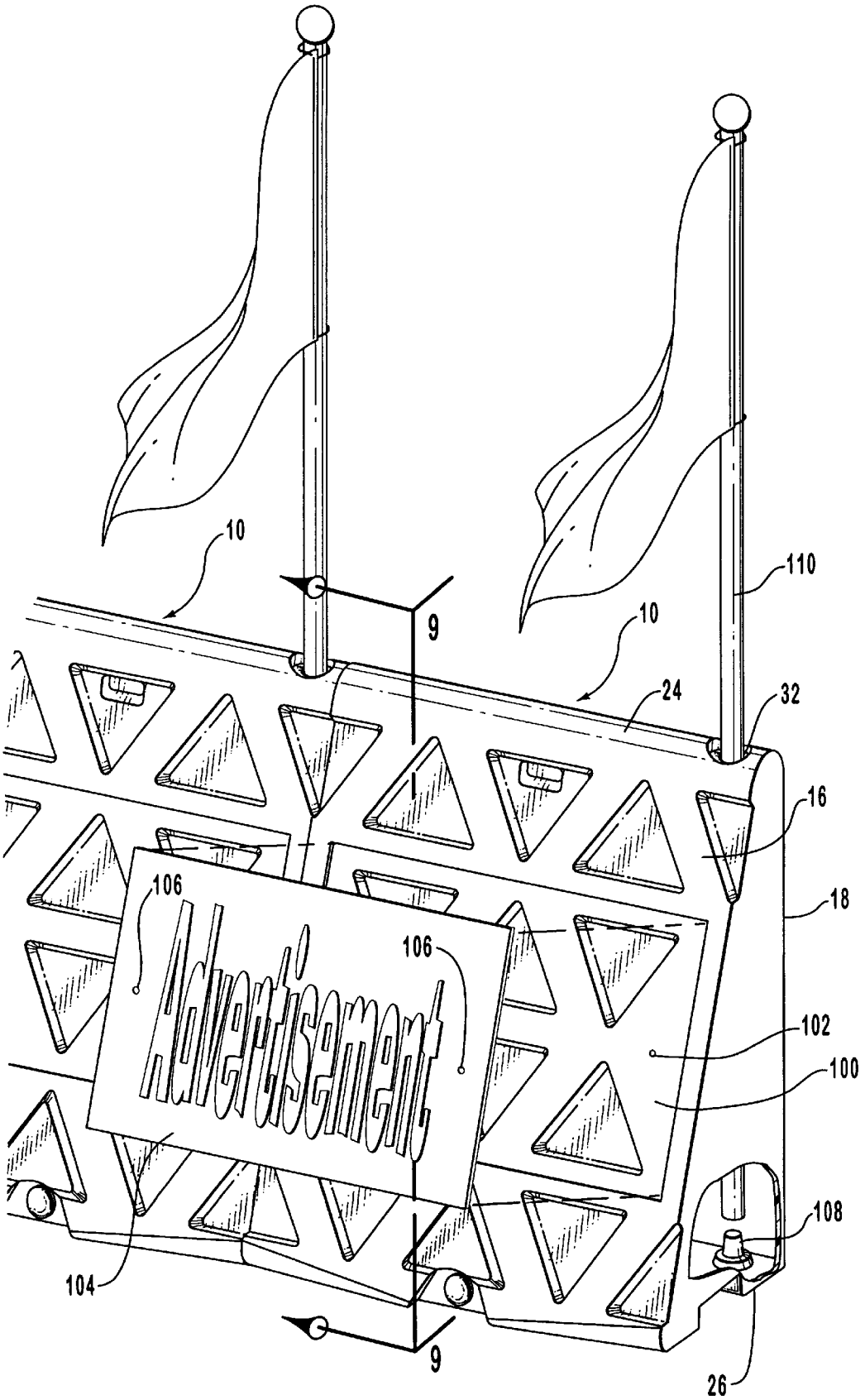
FIG. 8 is a partially cut away perspective view of the barriers shown in FIG. 6.
Figure 9:
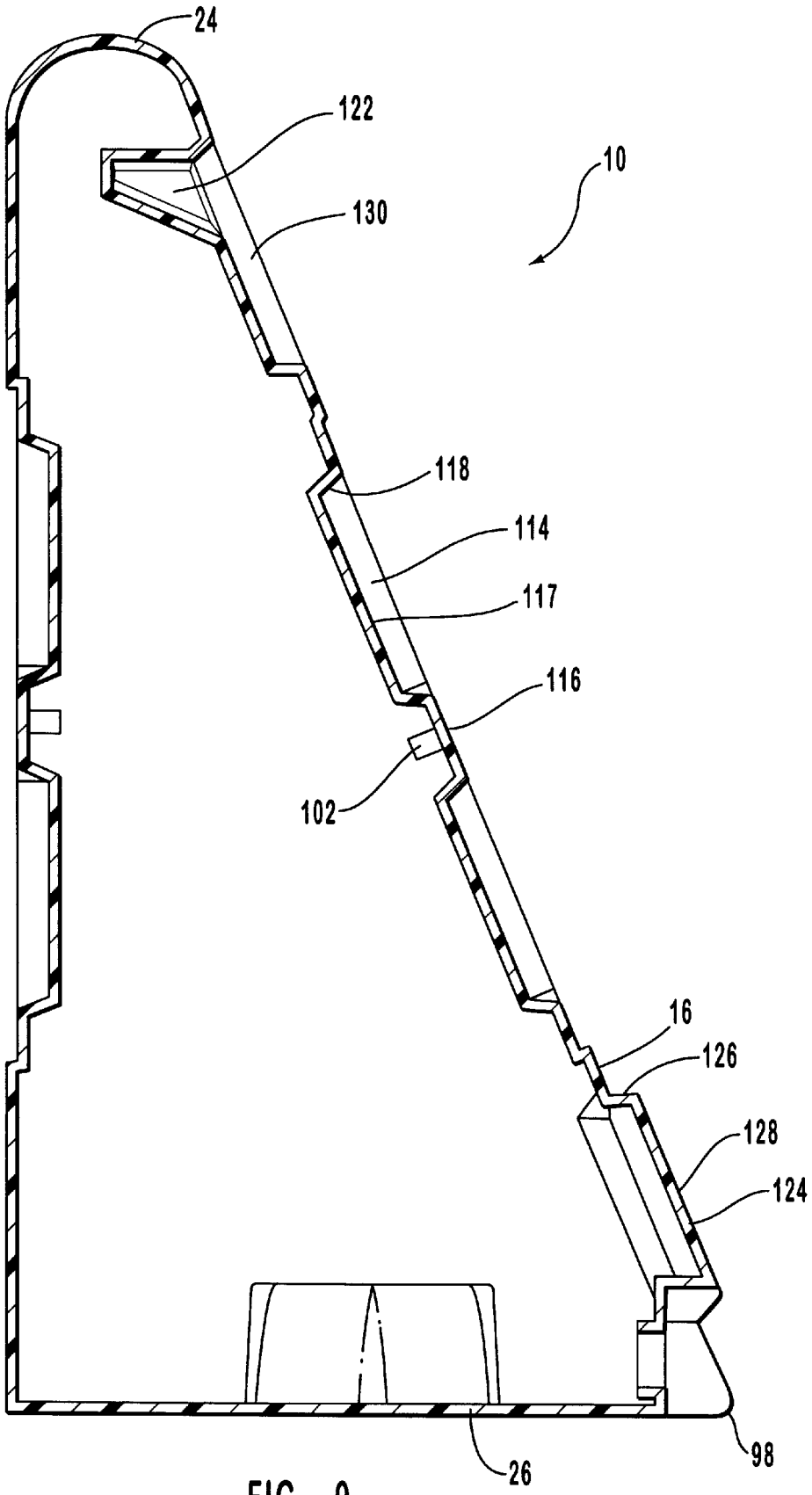
FIG. 9 is a cross-sectional side view of the barrier shown in FIG. 8 taken along section line 9—9.

Depicted in FIG. 8, barrier 10 has a display recess 100 formed in front wall 16. Display recess 100 is depicted as having a substantially rectangular configuration. In alternative embodiments, recess 100 can have other geometrical configuration such as circular, triangular, or square. Formed within display recess 100 are a pair of hollow plugs 102. Hollow plugs 102 are configured to receive a threaded insert 58. It is preferred that display recess 100 be sufficiently deep such that when a display 104 is received therein, the front face of display 104 is substantially flush with the surface of front face 16. This helps to prevent people standing adjacent to barrier 10 from being caught on the edge of display 104. Display 104 is secured to barrier 10 by passing bolts through apertures 106 in display 104 which in turn threadedly engage with threaded inserts 58 in hollow plugs 102. A similar display recess can also be formed on back wall 18.

As also depicted in FIG. 8, upwardly projecting from floor 26 of barrier 10 is a substantially conical post 108. Post 108 is aligned with opening 32 at top end 24 of barrier 10. Post 108 is configured to be received in the end of a hollow pole 110 such as a flag pole. As a result of post 108 being substantially conical, post 108 can be snugly received within a variety of alternative pole sizes. In alternative embodiments, post 108 can be different configurations to receive different pole configurations.

As previously discussed, barriers 10 are configured such that sidewalls 20 and 22 radially bow out when filled with a ballast. In one embodiment of the present invention, means are provided for substantially preventing the bowing of front wall 16 and back wall 18 when internal chamber 30 is filled with a ballast. By preventing the bowing of front wall 16 and back wall 18, deformation to any displays mounted thereon is minimized and the pressure applied to sidewall 20 and 22 by the ballast is maximized. By way of example and not by limitation, a plurality of pockets 114 are recessed within top surface 116 of front wall 16 and back wall 18. Each of pockets 114 includes a floor 117 and a sloping reinforcing rib 118 extending between top surface 116 and floor 117. Reinforcing ribs 118 provide structural integrity and stiffening to both front wall 16 and back wall 18 which substantially prevents bowing of the walls.

In the embodiment depicted, reinforcing ribs 118 having a substantially triangular configuration. In alternative embodiments, reinforcing ribs 118 can have alternative geometrical configurations. For example, reinforcing ribs 118 can be circular, square, irregular, or other polygonal configuration. Furthermore, reinforcing ribs 118 can smoothly transition into floor 117. For example, pockets 114 can be can have a semi-spherical configuration. In yet other embodiments, pockets 114 can be replaced with elongated reinforcing ribs that extending across front wall 16 and back wall 18.

To further ensure that only sidewalls 20 and 22 are bowed during filling with ballast, it is also preferred that sidewalls 20 and 22 be smooth and uniform. In this configuration, the rigidity of sidewalls 20 and 22 is minimized, thereby helping to insure that sidewalls 20 and 22 are bowed rather then front wall 16 and back wall 18.

In one embodiment of the present invention, a hand hold 122 is recessed within front wall 16 adjacent to top end 24. Hand hold 122 enables easy moving an manipulation of barrier 10. A similar hand hold can also be positioned on back wall 18.

The present invention also includes means for mechanically mating a pair of barriers together such that the resulting combination has a substantially square transverse cross-section. By way of example and not by limitation, projecting from front wall 16 adjacent to floor 26 is a tenon 124. In the embodiment depicted, tenon 124 comprises a substantially inverted pocket 114. That is, tenon 124 comprises an outwardly projecting reinforcing rib 126 that terminates at an end wall 128. Tenon 124 is configured complementary to a mortise 130 projecting into front wall 16 adjacent to top portion 24. Mortise 130 can also function as a pocket 114 as previously discussed.

Figure 10:
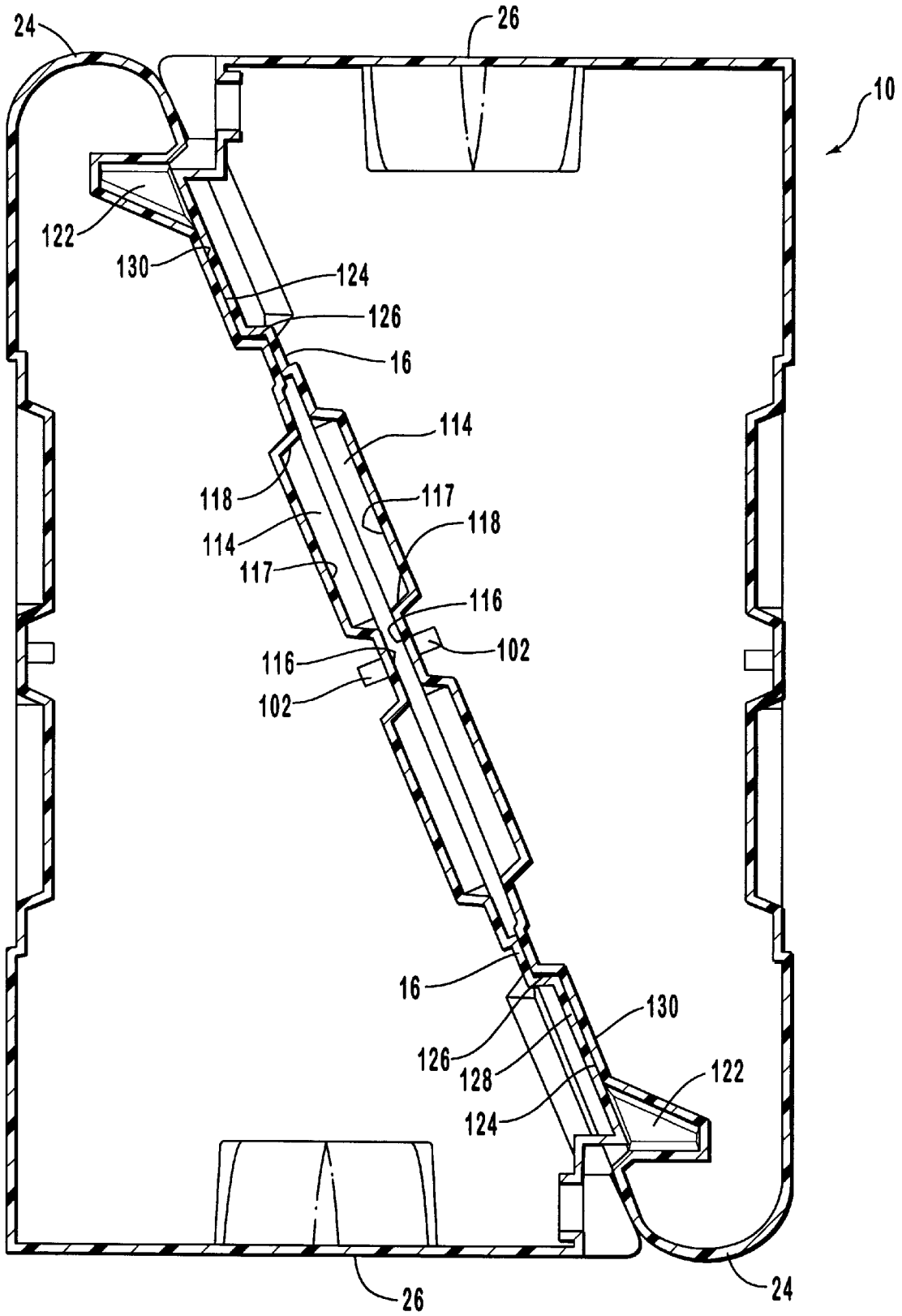
FIG. 10 is a cross-sectional side view of a pair of barriers shown in FIG. 9 coupled together.

As depicted in FIG. 10, by inverting a second barrier and biasing front walls 16 theretogether, tenon 124 of each of barriers 10 can be received within the corresponding mortise 130 of the opposing barrier. As such, barriers 10 are mated together. When sidewalls 22 and 24 form a right triangle, the resulting mated barriers 10 have a substantially square transverse cross-section. As a result, the mated barriers 10 are easily stacked for transport or storage. In alternative embodiments, tenon 124 and mortise 130 can be a variety of alternative configurations and need only be constructed so that they mate together. Similar mortise and tenon configurations can also be formed on back wall 18 of barrier 10 for connecting adjacent back walls of barriers 10 together.

Figure 11:
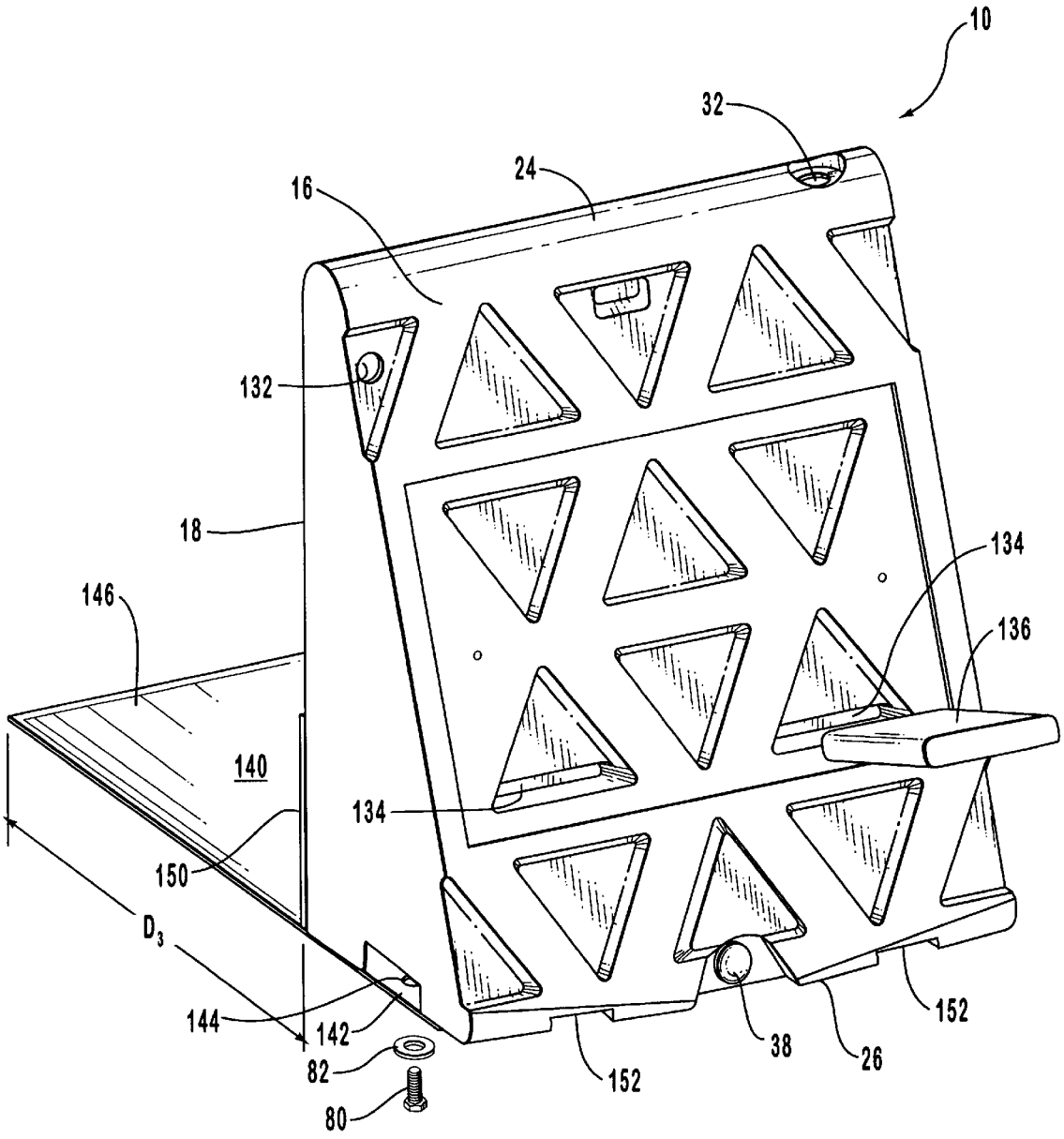
FIG. 11 is a perspective view of an alternative barrier shown in FIG. 1.

Depicted in FIG. 11, a tie-down port 132 extends between front wall 16 and back wall 18. Tie-down port 132 enables structures to be tied to barrier 10 by passing a rope, strap or other type of cord through tie-down port 132. Barrier 10 depicted in FIG. 11 also incorporates a foot hold on front wall 16. The foot hold can comprise a large recess 134 into which a foot can be received or step 136. Step 136 can be secured within recess 134 so that a user can stand on the end thereof. In alternative embodiments, a step can be integrally molded into front wall 16. The foot hold enables a person to reach over barrier 10 as needed. Of course, it is also envisioned that a foot hold can be positioned on back wall 18.

When it is desirable to minimize the potential for barrier 10 to be tipped over, such as in crowded events, a plate 140 can be attached to thereto. Plate 140 comprises a first end 142 having a pair of apertures 144 extending therethrough. Apertures 144 are configured to line up with threaded inserts 58 as previously discussed with regard to FIG. 2. As a result, bolt 80 can be used to secure plate 140 to barrier 10. Second end 146 of plate 140 projects away from barrier 10 along a ground surface. In one embodiment, plate 140 projects away from barrier 10 for a distance $D_3$ greater than 1 foot preferably greater than about 2 feet and more preferably greater than about 4 feet. By facing plate 140 towards the crowed, people will be standing on plate 140, thereby making it more difficult for barrier 10 to be tipped, over. In alternative embodiments, rails 150 can extend from plate 140 up back wall 18. By securing rails 150 to back wall 18, the leverage against bolts 80 is minimized.

In yet another embodiment, fork lift apertures 152 can extend through either or both front wall 16 and back wall 18 and along floor 26. Fork lift apertures 152 are configured to receive the tines of a fork lift such that, if desired, barrier 10 can be moved by a fork lift even if filled with ballast.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A barrier system operable with a ballast, the barrier system comprising:

(a) a pair of discrete, movable barriers, each of the barriers comprising:

(i) a housing including a pair of opposing sidewalls and a floor extending therebetween, each of the sidewalls having a uniformly substantially smooth exterior surface;

(ii) an interior surface defining an internal chamber; and (iii) means for filling internal chamber with the ballast; and (b) means for connecting together the pair of discrete barriers such that the strength of the connection therebetween increases by frictional engagement as each of the barriers are filled with the ballast.

2. A barrier system as recited in claim 1, wherein the means for connecting comprises:

(a) a slot upwardly extending in the floor of each of the barriers; and (b) a connector comprising a cross member having a pair of legs upwardly extending therefrom, each of the legs being configured to be received within the slot of a corresponding barrier when the sidewalls of the discrete barriers are adjacently disposed.

3. A barrier system as recited in claim 2, wherein each of the legs of the connector has an inside face that inwardly slopes towards the opposing leg.

4. A barrier system as recited in claim 2, wherein each of the sidewalls of the barriers are configured to bow outwardly when the barriers are filled with the ballast.

5. A barrier operable with a ballast, the barrier comprising:

(a) a housing including a front wall and a back wall each extending between opposing sidewalls, the housing also including an interior surface defining an internal chamber, the internal chamber communicating with the exterior through an opening, each of the sidewalls bowing inwardly so as to be concave when the internal chamber is empty and bowing outwardly so as to be convex when the internal chamber is filled with the ballast; and (b) means for substantially preventing bowing of at least one of the front face and the back face when the internal chamber of the housing is filled with the ballast.

6. A barrier as recited in claim 5, wherein the means for substantially preventing bowing comprises a plurality of pockets recessed within the front wall and the back wall.

7. A barrier as recited in claim 5, wherein the side walls are substantially planar and have a substantially uniform thickness.

8. A barrier as recited in claim 5, further comprising a display recess formed in one of the back wall or front wall.

9. A barrier as recited in claim 5, further comprising a tie-down port extending between the front wall and the back wall, the tie-down port comprising an aperture extending through the barrier.

10. A barrier system comprising a pair of discrete, movable barriers, each of the barriers including:

(a) a housing having an exterior surface with a substantially triangular transverse cross section and an interior surface defining an internal chamber, the internal chamber communicating with the exterior through an opening;

(b) means for mechanically mating the pair of barriers together such that the resulting combination has a substantially square transverse cross section; and (c) a post upwardly extending from the interior surface of the housing, the post being in alignment with the opening in the housing.

11. A barrier system as recited in claim 10, wherein the means for mechanically mating comprises:

(a) each housing having a floor with a back wall orthogonally extending from the floor to a top end and a front wall extending at an angle from the floor to the top end;

(b) a tenon projecting from the front wall; and (c) a mortise spaced from the tenon and recessed within the front wall, the mortise being positioned such that when one of the barriers is inverted and the front walls of the barriers are biased together, the mortise of each barrier receives the tenon of the other barrier.

12. A barrier system including a pair of barriers, each of the barriers comprising:

(a) a housing having a sloping front wall and an interior surface defining an internal chamber, the internal chamber communicating with the exterior through an opening;

(b) a mortise recessed within the front wall of the housing; and (c) a tenon spaced from the mortise and projecting from the front wall, the tenon and mortise being configured such that the tenon of each of the barriers can be complementary received within the mortise of the other barrier when the sloping front walls of the barriers are biased together.

13. A barrier system as recited in claim 12, wherein the tenon has a triangular configuration.

14. A barrier system as recited in claim 12, further comprising a foot rest formed on the front wall.

15. A barrier system as recited in claim 12, further comprising:

(a) the front wall extending between opposing side walls;

(b) a drain hole extending through the front wall adjacent to the floor; and (c) a drain ridge projecting upwardly from the floor and extending from a corresponding side wall to the drain hole.

16. A barrier system as recited in claim 12, wherein the housing further comprises a floor and a pair of fork lift apertures recessed therein.

17. A barrier operable with a ballast and selectively positioned on a ground surface, the barrier comprising:

(a) a housing having a floor extending between a front wall and a back wall, the housing also having an interior surface bounding an internal chamber, the internal chamber being configured to receive the ballast and communicating with the exterior through an opening;

(b) a plate removably mounted to the housing and projecting from the back wall along the ground surface when the floor of the housing is positioned over the ground surface; and (c) a rail mounted on and upwardly projecting from the plate so that at least a portion of rail is disposed adjacent to the back wall of the housing.

18. A barrier as recited in claim 17, wherein the plate is mounted to the floor.

19. A barrier as recited in claim 17, wherein the plate projects at least one foot away from the housing.

20. A barrier system operable with a ballast, the barrier system comprising:

(a) a first barrier comprising:

(i) a first housing including first and second opposing sidewalls and a floor extending therebetween, the first sidewall having an exterior surface with a central portion, the floor having a slot upwardly extending therein adjacent to the first sidewall; and (ii) an interior surface defining an internal chamber, the internal chamber being configured to receive a ballast, the first sidewall being configured to outwardly bow when the internal chamber is filled with ballast;

(b) a second barrier comprising:

(i) a second housing including first and second opposing sidewalls and a floor extending therebetween, the second sidewall having an exterior surface with a central portion, the floor having a slot upwardly extending therein adjacent to the second sidewall; and (ii) an interior surface defining an internal chamber, the internal chamber being configured to receive a ballast, the second sidewall being configured to outwardly bow when the internal chamber is filled with ballast;

(c) a substantially U-shaped connector having upstanding first and second legs, the first leg being selectively received within the slot formed on the floor of the first barrier and the second leg being selectively received within the slot formed on the floor of the second barrier, the barriers being configured such that when the first and second barriers are filled with ballast, the first sidewall of the first barrier and the second sidewall of the second barrier each outwardly bow so that the central portion of the first sidewall of the first barrier directly biases in frictional, non-mechanical engagement against the central portion of the second sidewall of the second barrier.

21. A barrier system as recited in claim 20, wherein the first sidewall of the first barrier and the second sidewall of the second barrier are bowed inwardly so as to be convex when the internal chamber of the first and second barriers are absent of ballast.

22. A barrier system as recited in claim 21, wherein the central portion of the exterior surface of the first sidewall of the first barrier is spaced apart from the central portion of the exterior surface of the second sidewall of the second barrier when the barriers are connected together by the connector and the first and second barriers are absent of ballast.

23. A barrier system as recited in claim 20, wherein the connector is bolted to the first barrier and the second barrier.

24. A barrier system as recited in claim 20, wherein each of the legs of the connector has an inside face that inwardly slopes towards the opposing leg.

* * * * *

UNITED STATES PATENT AND TRADEMARK OFFICE

CERTIFICATE OF CORRECTION

PATENT NO. : 6,086,285

DATED : July 11, 2000

INVENTOR(S) : Marc E. Christensen

It is certified that error appears in the above-identified patent and that said Letters Patent is hereby corrected as shown below:

On the Title Page, Abstract, 10 rows from the bottom, after "from" change "an" to --a--

Col. 3, line 35, before "perspective" insert an --a--

Col. 3, line 58, before "shown" insert --to the one--

Col. 5, line 3, before "comprises" change "22" to --42--

Col. 5, line 9, after "platform 54" insert --as shown in Fig. 6--

Col. 5, line 13, after "substantially" delete "8"

Col. 6, line 27, after "rubbers and" change "elastomerss" to --elastomers--

Col. 7, line 51, after "moving" change "an" to --and--

Col. 8, line 51, after "only" change "as illustrated" to --as illustrative--

Signed and Sealed this

Eighth Day of May, 2001

*Attest:*

Nicholas P. Godici

NICHOLAS P. GODICI

*Attesting Officer*

*Acting Director of the United States Patent and Trademark Office*